US007432696B1

(12) United States Patent
De Stasi

(10) Patent No.: US 7,432,696 B1
(45) Date of Patent: Oct. 7, 2008

(54) APPARATUS AND METHOD FOR LOW INPUT VOLTAGE CURRENT MIRROR CIRCUIT

(75) Inventor: Frank John De Stasi, San Leandro, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 535 days.

(21) Appl. No.: 11/185,055

(22) Filed: Jul. 19, 2005

(51) Int. Cl.
*G05F 1/40* (2006.01)
*G05F 1/10* (2006.01)

(52) U.S. Cl. ..... 323/315; 323/316; 327/543

(58) Field of Classification Search ..... 323/315–317; 327/538–543

See application file for complete search history.

(56) References Cited

U.S. PATENT DOCUMENTS 6,194,956 B1 * 2/2001 Barnes ..... 327/538
6,313,692 B1 11/2001 Pease
6,856,190 B2 * 2/2005 Kihara ..... 327/541
6,924,674 B2 * 8/2005 Jalaleddine et al. ..... 327/112
7,071,770 B2 * 7/2006 Jung ..... 327/543

* cited by examiner

*Primary Examiner*—Matthew V Nguyen
(74) *Attorney, Agent, or Firm*—Darby & Darby PC; Matthew M. Gaffney

(57) ABSTRACT

A low-voltage current mirror circuit is provided. The low-voltage current mirror circuit includes a current mirror including first and second transistors, a buffer circuit, and a third transistor. The first transistor is the input transistor to the low-voltage current mirror circuit. Additionally, the source of the third transistor is coupled to the drain of the first transistor. The buffer circuit is configured to cause the voltage at the gate of the third transistor and the voltage at the gage of the first transistor to be substantially equal. Also, the low-voltage current mirror circuit is arranged such that the drain current provided to the third transistor is relatively small such that the Vgs of the third transistor is roughly equal to the threshold voltage $V_{TH}$. Accordingly, the input voltage of the low-voltage current mirror circuit is approximately equal to Vgs-$V_{TH}$.

22 Claims, 6 Drawing Sheets

APPARATUS AND METHOD FOR LOW INPUT VOLTAGE CURRENT MIRROR CIRCUIT

FIELD OF THE INVENTION

The invention is related to current mirrors, and in particular, to an apparatus and method for a current mirror circuit which includes circuitry that causes the input voltage of the current mirror to be approximately $V_{GS}$-$V_{TH}$.

BACKGROUND OF THE INVENTION

A current mirror is a well-known building block in analog circuit design. A current mirror may be used to provide an output current from an input current. Further, a current mirror may be used to provide an output current that is the same as the input current, or the current mirror may be ratioed.

FIG. 1 illustrates a typical current mirror, which consists of transistors M0 and M1. Transistor M0 is arranged in a diode configuration with its gate coupled to its drain. The input voltage (Vin) of the current mirror is equal to $Vgs_{M0}$. $Vgs_{M0}$ is given by $V_{TH}+\Delta V$, where $V_{TH}$ is the threshold voltage, and $\Delta V$ is the over-drive, which should typically be several hundred milliVolts for good matching betweens transistors M0 and M1. Typically, transistor M1 operates in saturation, so that overdrive voltage $\Delta V$ is needed so that transistor M0 is also in saturation for good matching between transistors M0 and M1.

For example, in a case where $V_{TH}$=0.7V and $\Delta V$=300 mV, Vin=$Vgs_{M0}$=1.0V.

BRIEF DESCRIPTION OF THE DRAWINGS

Non-limiting and non-exhaustive embodiments of the present invention are described with reference to the following drawings, in which.

DETAILED DESCRIPTION

Figure 1:
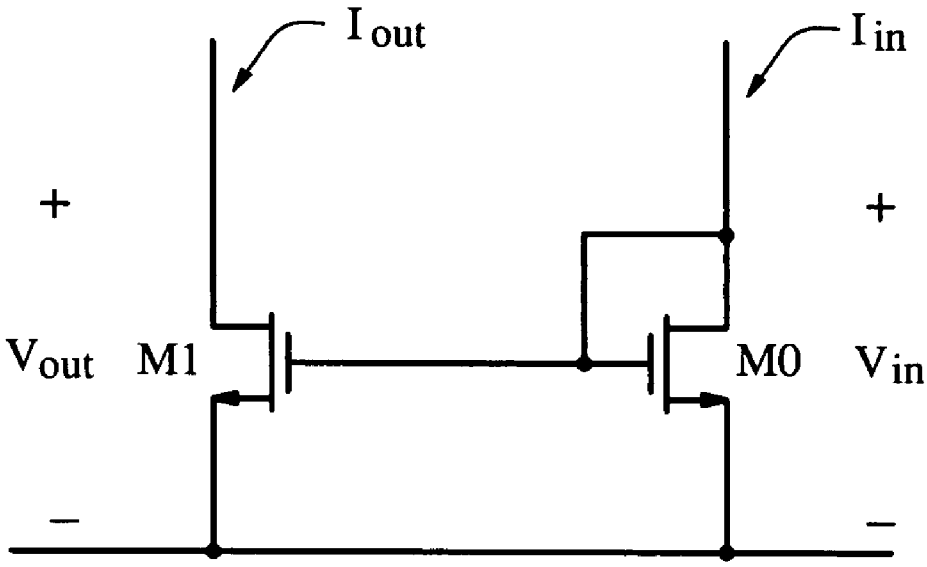
Figure 1 Prior Art
FIG. 1 shows a block diagram of a current mirror according to the prior art.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" includes plural reference, and the meaning of "in" includes "in" and "on." The phrase "in one embodiment," as used herein does not necessarily refer to the same embodiment, although it may. The term "coupled" means at least either a direct electrical connection between the items connected, or an indirect connection through one or more passive or active intermediary devices. The term "circuit" means at least either a single component or a multiplicity of components, either active and/or passive, that are coupled together to provide a desired function. The term "signal" means at least one current, voltage, charge, temperature, data, or other signal. Where either a field effect transistor (FET) or a bipolar transistor may be employed as an embodiment of a transistor, the scope of the words "gate", "drain", and "source" includes "base", "collector", and "emitter", respectively, and vice versa.

Briefly stated, the invention is related to a low-voltage current mirror circuit that includes: a current mirror including first and second transistors, a buffer circuit, and a third transistor. The first transistor is the input transistor to the low-voltage current mirror circuit. Additionally, the source of the third transistor is coupled to the drain of the first transistor. The buffer circuit is configured to cause the voltage at the gate of the third transistor and the voltage at the gate of the first transistor to be substantially equal. Also, the low-voltage current mirror circuit is arranged such that the drain current provided to the third transistor is relatively small such that the Vgs of the third transistor is roughly equal to the threshold voltage $V_{TH}$. Accordingly, the input voltage of the low-voltage current mirror circuit is approximately equal to Vgs-$V_{TH}$.

Figure 2:
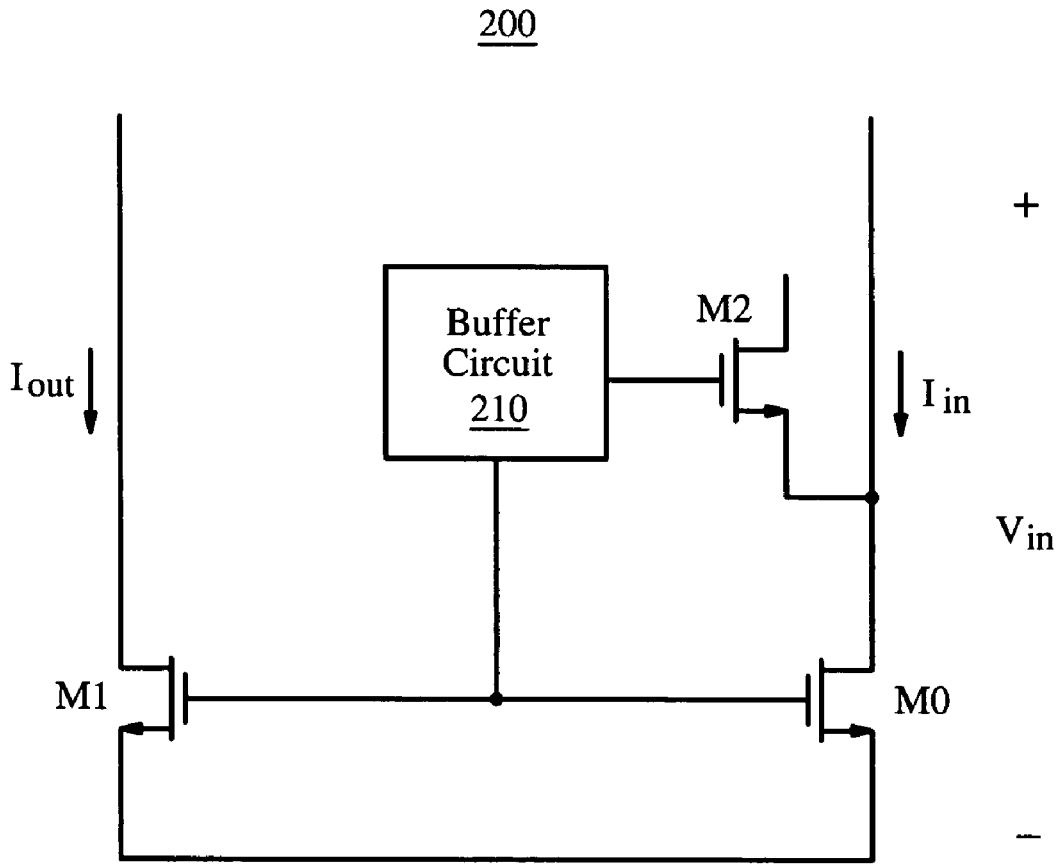
FIG. 2 illustrates a block diagram of an embodiment of a low-voltage current mirror circuit.

FIG. 2 illustrates a block diagram of an embodiment of low-voltage current mirror circuit 200. Low-voltage current mirror circuit 200 may include transistors M0-M2 and buffer circuit 210. The drain connection to transistor M2 is not shown in FIG. 2 because it may be coupled in different ways in different embodiments. The drain of transistor M2 may be coupled to the gate of transistor M2, or the drain of transistor M2 may be coupled to a bias current source (not shown) that provides a relatively small current, or both, and/or the like.

Transistors M0 and M1 operate as a current mirror. In one embodiment, buffer circuit 210 is arranged to cause the voltage at the gate of transistor M2 and the voltage at the gate of transistor M0 to be substantially equal to each other.

Additionally, low-voltage current mirror circuit 200 is arranged such that the drain current received by transistor M2 is sufficiently small that $Vgs_{M2}$ is relatively close to the threshold voltage $V_{TH}$ of transistor M2, where the threshold voltages of transistors M0 and M2 are approximately equal. For example, if the drain current of transistor M2 is in the nanoAmpere range, Vgs2 is only slightly larger than $V_{TH}$. In one embodiment, transistor M2 is arranged in a diode configuration with its drain coupled to its gate, and buffer circuit 210 provides the relatively small drain current to the drain of transistor M2. In another embodiment, transistor M2 is arranged as a source follower, and a bias current source (not shown) is coupled to the drain of transistor M2 to provide the relatively small current to the drain of transistor M2.

Due to the relatively small drain current of transistor M2, $Vgs_{M2}$ is roughly equal to $V_{TH}$. Accordingly, VIN (which is equal to $Vds_{M0}$) may be substantially given by $Vgs_{M0}$-$V_{TH}$=$\Delta V$. Overdrive voltage $\Delta V$ is the minimum voltage necessary to keep transistor M0 in saturation.

Although one embodiment of low-voltage current mirror circuit 200 is illustrated in FIG. 2 for illustrative purposes, other embodiments are within the scope and spirit of the invention. For example, although transistors M0-M2 are illustrated as MOSFETs in FIG. 2, in other embodiments, transistors M0-M2 may be MESFETs, and/or the like. Additionally, low-voltage current mirror circuit 210 may include more components than are shown in FIG. 2, such as cascode transistors, or the like. Further, although transistors M0-M2 are each shown as an n-type transistor in FIG. 2, in other embodiments, transistors M0-M2 may be p-type transistors. These variations and others are within the scope and spirit of the invention.

In another embodiment, buffer circuit 210 is not included in current mirror circuit 200, the gate of transistor M0 is connected to the gate of transistor M2, and the drain of transistor M2 is coupled to a bias current source circuit that provides the relatively low current to the drain of transistor M2.

In one embodiment, low-voltage current mirror circuit 200 may be used in a white LED driver, where the sensed LED current is scaled and used to control a switching regulator to maintain constant LED current. Additionally, low-voltage current mirror circuit 200 may be used for virtually any application in which a current mirror is employed, including sense-and-limit, sense-and-control, and sense-and mirror applications. In one embodiment, low-voltage current mirror circuit 200 allows a load current to be ratiometrically mirrored with a very low voltage drop across the sense device. In this way, a large current can be sensed at low voltages. Further, low-voltage current mirror circuit 200 may be included in an integrated circuit.

Low-voltage current mirror circuit 200 may be particularly useful in low voltage systems. The higher the input voltage burden, the less voltage is available for the "sensed current"; with less voltage available, the circuit performance may be reduced or the value of the sensed current may be altered. By employing circuit mirror circuit 200, this may be prevented.

Also, low-voltage current mirror circuit 200 may be employed to reduce power loss. If a current mirror is part of an integrated circuit, excessive power dissipation may raise the integrated circuit temperature and may restrict the maximum operating temperature of the device. Also, this power loss may reduce the efficiency of the entire system. By employing low-voltage current mirror circuit 200, power dissipation may be reduced.

Figure 3:
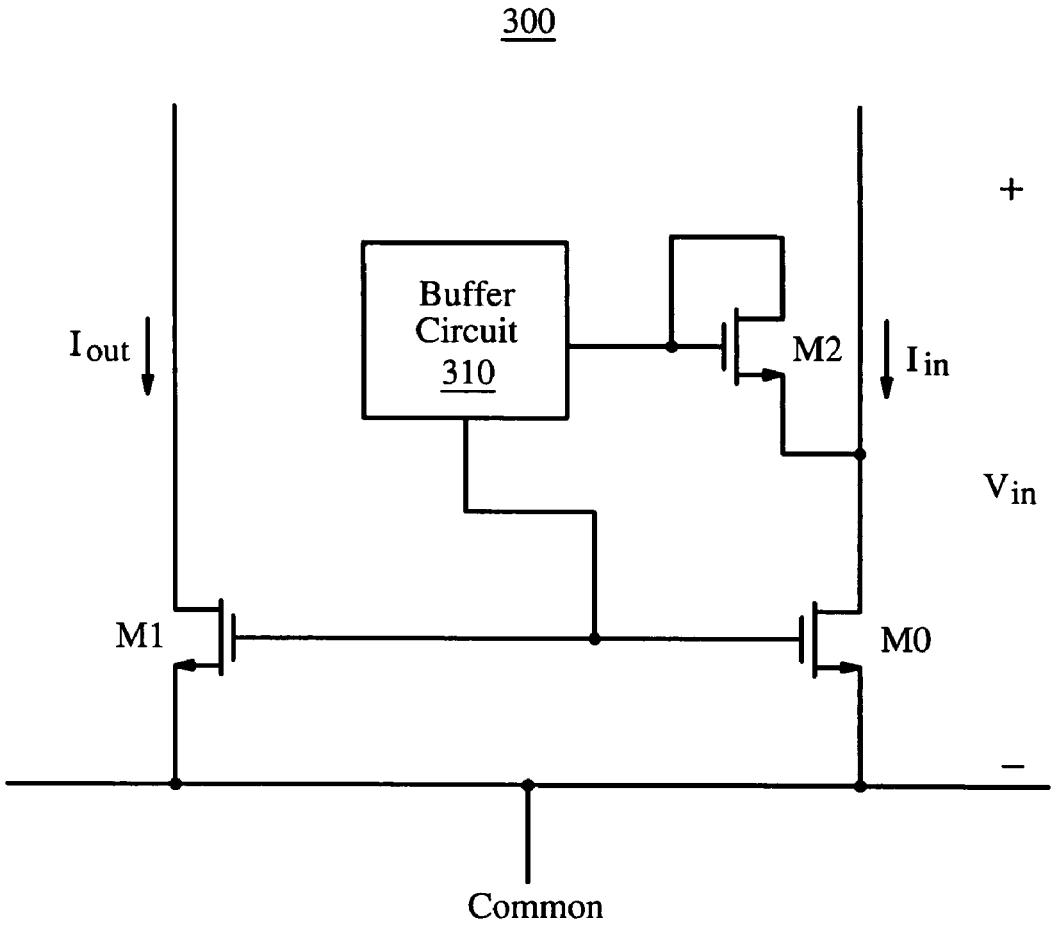
FIG. 3 shows a block diagram of an embodiment of the low-voltage current mirror circuit of FIG. 2.

FIG. 3 shows a block diagram of an embodiment of low-voltage current mirror circuit 300, which may be employed as an embodiment of low-voltage current mirror circuit 200 of FIG. 2. In low-voltage current mirror circuit 300, transistor M2 is arranged in a diode configuration.

In one embodiment, transistors M0 and M1 are n-type transistors, and the common node at the sources of transistor M0 and M1 is coupled to Ground. In another embodiment, transistors M0 and M1 are p-type transistors, and the common node is coupled to VDD. These variations and others are within the scope and spirit of the invention.

Figure 4:
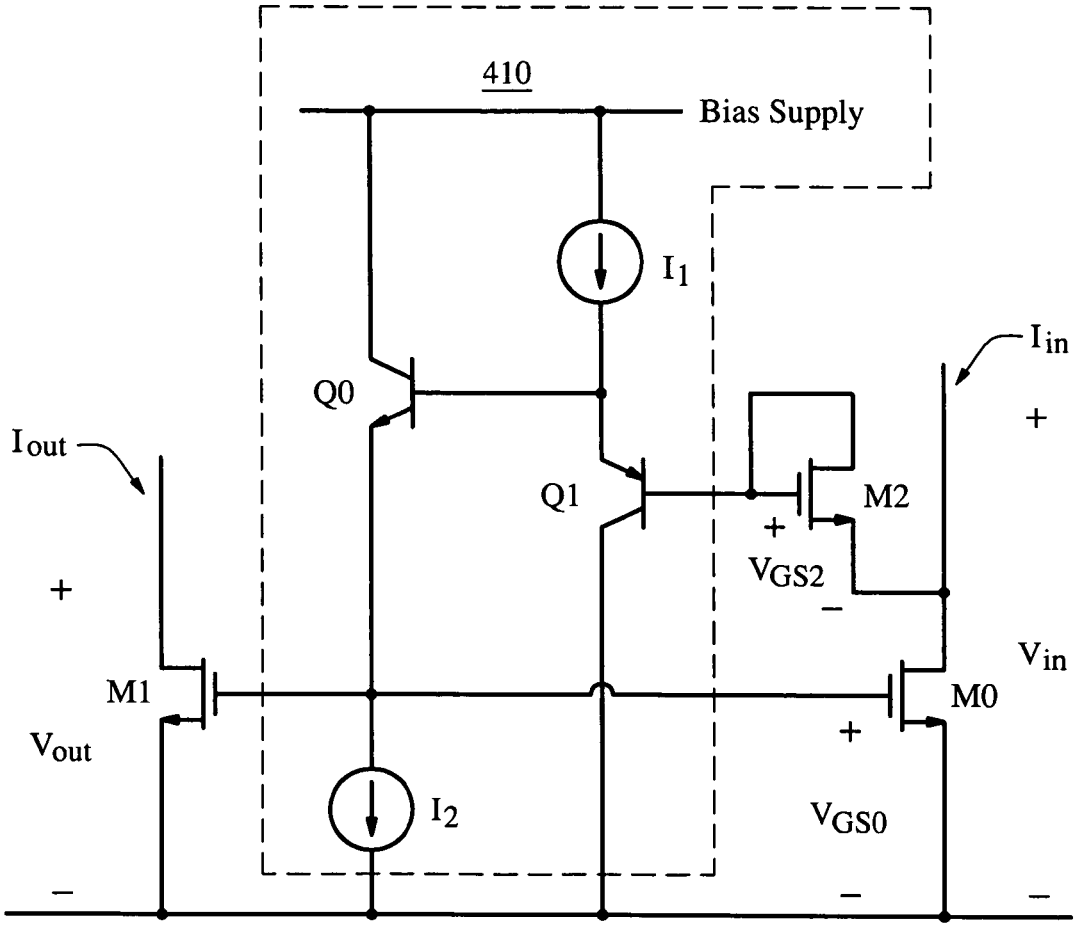
FIG. 4 illustrates a block diagram of an embodiment of the low-voltage current mirror circuit of FIG. 3.

FIG. 4 illustrates a block diagram of an embodiment of low-voltage current mirror circuit 400, which may be employed as an embodiment of low-voltage current mirror circuit 300 of FIG. 3. Buffer circuit 410 is a folded buffer that may include transistors Q1 and Q2 and bias current sources I1 and I2.

In operation according to one embodiment, bias current source I1 provides a bias current to transistor Q1, and bias current source I2 provides a bias current to transistor Q0. In one embodiment, currents I1 and I2 are approximately the same, but slightly skewed to approximately minimize the offset between the base-emitter voltage drops of transistors Q0 and Q1.

In one embodiment, the base-emitter junctions of transistors Q0 and Q1 operate as a translinear loop such that the voltage of the gate of transistor M2 and the voltage at the gate of transistor M0 are substantially equal. In this embodiment, transistor Q1 provides a base current of approximately I1/($\beta_F$+1), which is a relatively small current provided to the drain of transistor M2 so that $Vgs_{M2}$ is relatively close to $V_{TH}$.

Although one embodiment of buffer circuit 410 is illustrated in FIG. 4, many other embodiments are within the scope and spirit of the invention. For example, in one embodiment, additional components may be added to buffer circuit 410. In one embodiment, buffer circuit 410 further includes a resistor that is coupled to the emitter of transistor Q1. Also, the embodiment of buffer circuit 410 illustrated in FIG. 4 provides a voltage at the gate of transistor M2 that is substantially the same as the voltage at the gate of transistor M0 by going up one VBE and going down one VBE. In other embodiments, buffer circuit 410 may include additional components for going up two VBEs and down two VBEs, for going up three VBEs and going down three VBEs, or the like.

Additionally, in some embodiments, transistor Q0 may be replaced with a diode, resistor, and/or the like. Also, although FIG. 4 illustrates transistor M0 and M1 as an n-type current mirror that is coupled to ground, in another embodiment, transistors M0 and M1 may be p-type transistors coupled to VDD. These variations and others are within the scope and spirit of the invention.

Figure 5:
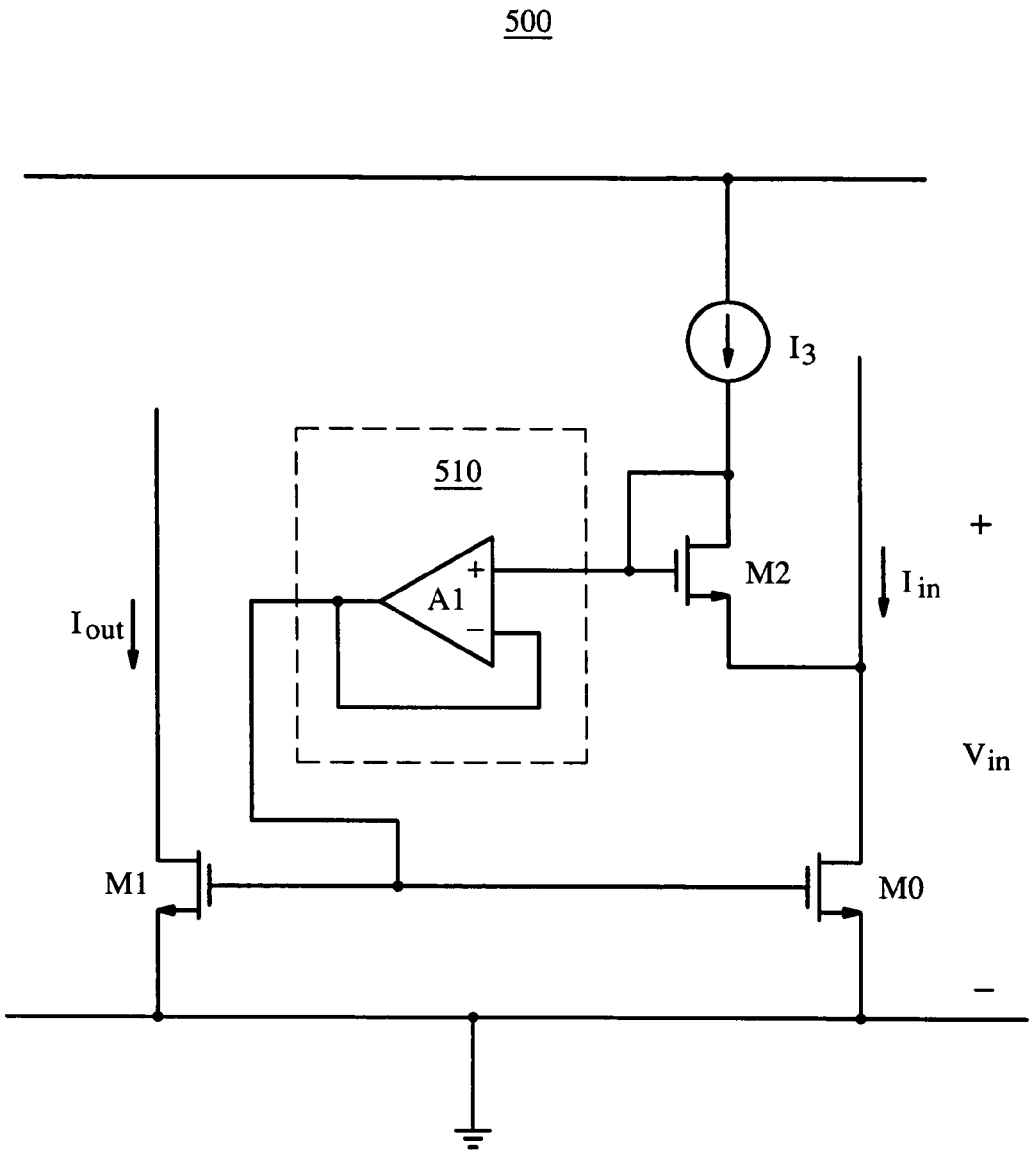
FIG. 5 shows a block diagram of another embodiment of the low-voltage current mirror circuit of FIG. 3.

FIG. 5 shows a block diagram of an embodiment of low-voltage current mirror circuit 500, which may be employed as an embodiment of low-voltage current mirror circuit 300 of FIG. 3. Buffer circuit 510 includes op amp A1, which is arranged as a follower. Op amp A1 may be CMOS, bipolar, or the like.

Figure 6:
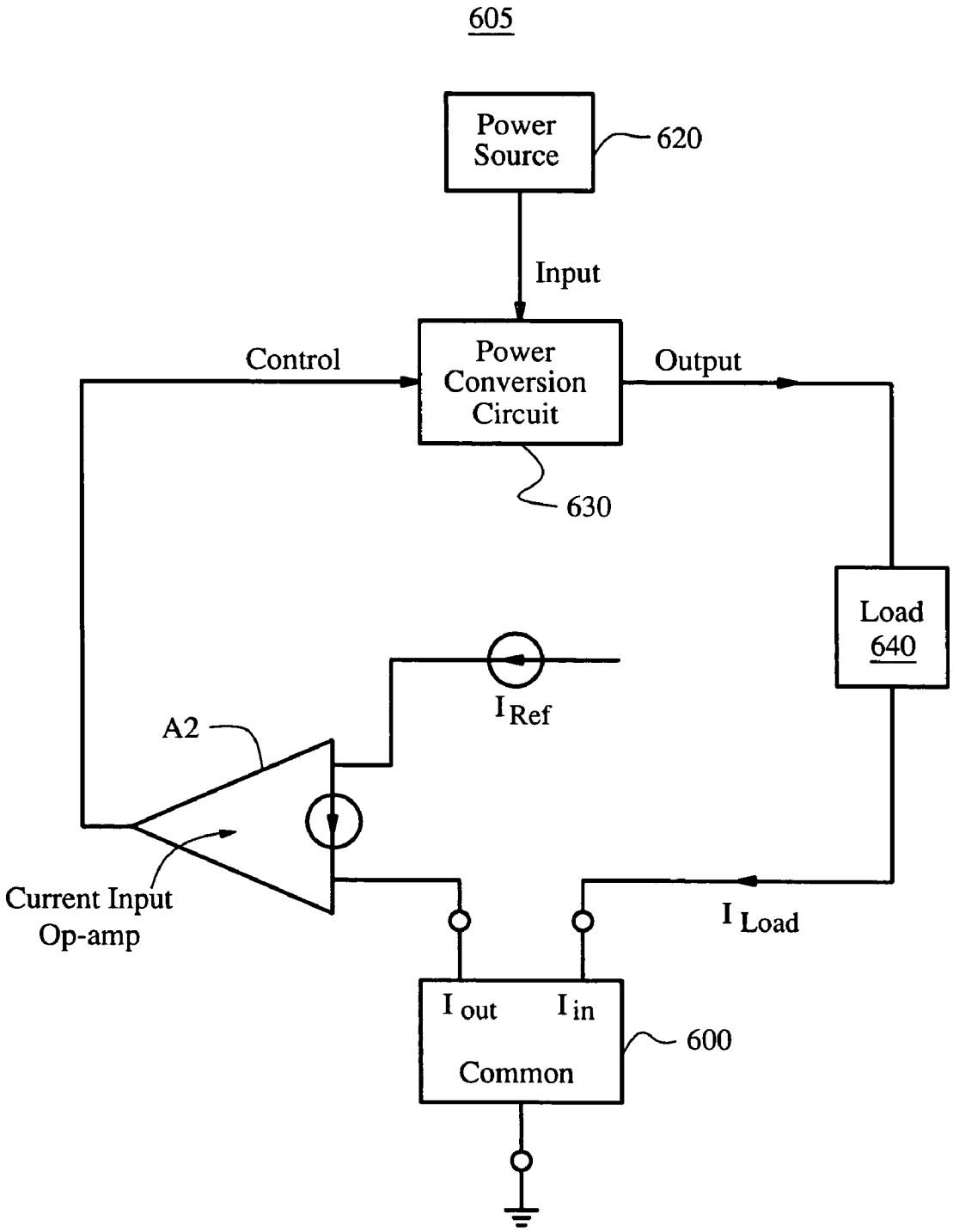
FIG. 6 illustrates a block diagram of an embodiment of a regulator circuit that includes an embodiment of the low-voltage current mirror circuit of FIG. 2, arranged in accordance with aspects of the present invention.

FIG. 6 illustrates a block diagram of an embodiment of regulator circuit 605. Regulator circuit 605 includes power source 620, power conversion circuit 630, load 640, current input op amp A2, and low-voltage current mirror circuit 600. Low-voltage current mirror circuit 600 includes an embodiment of low-voltage current mirror circuit 200 of FIG. 2.

Although FIG. 6 illustrates one example of an application for low-voltage current mirror circuit 200. Although one embodiment is shown in FIG. 6, as previously discussed, embodiments of low-voltage current mirror circuit 200 may be used in a variety of different applications, including current sensing or measuring, current limiting or protection, and/or the like.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. A low-voltage current mirror circuit, comprising:

a current mirror including a first transistor and a second transistor, wherein the first transistor has at least a gate, a drain, and a source; the second transistor has at least a gate, a drain, and a source; and wherein the gate of the first transistor is coupled to the gate of the second transistor;

a third transistor having at least a gate, a drain, and a source, wherein the source of the third transistor is coupled to the drain of the first transistor, and wherein the third transistor is arranged such that:

a voltage at the gate of the third transistor is substantially equal to the voltage at the gate of the first transistor; and such that a drain current of the third transistor is relatively small such that a voltage difference between the gate and source of the third transistor is roughly equal to a threshold voltage of the third transistor.

2. The low-voltage current mirror circuit of claim 1, wherein the first transistor is a MOSFET or a MESFET, the second transistor is a MOSFET or a MESFET, and wherein the third transistor is a MOSFET or a MESFET.

3. The low-voltage current mirror circuit of claim 1, further comprising a bias current source that is coupled to the drain of the third transistor, wherein the gate of the third transistor is connected to the gate of the first transistor.

4. The low-voltage current mirror circuit of claim 1, further comprising a buffer circuit that is coupled between the gate of the first transistor and the gate of the third transistor, wherein the buffer circuit is arranged such that the voltage at the gate of the third transistor is substantially equal to the voltage at the gate of the first transistor.

5. The low-voltage current mirror circuit of claim 4, wherein the buffer circuit includes a translinear loop.

6. The low-voltage current mirror circuit of claim 4, wherein the buffer circuit includes:

an op amp having at least a first input, a second input, and an output, wherein the first input of the op amp is coupled to the gate of the third transistor, the second input of the op amp is coupled to the gate of the first transistor, and wherein the output of the op amp is coupled to the gate of the first transistor.

7. The low-voltage current mirror circuit of claim 6, further comprising:

a bias current source that is arranged to provide the drain current of the third transistor such that the drain current of the third transistor is relatively small, wherein the drain of the third transistor is coupled to the gate of the third transistor.

8. The low-voltage current mirror circuit of claim 4, wherein the buffer circuit includes:

a fourth transistor having at least a base, a collector, and an emitter, wherein the base of the fourth transistor is coupled to the gate of the third transistor.

9. The low-voltage current mirror circuit of claim 8, wherein the fourth transistor is a bipolar transistor.

10. The low-voltage current mirror circuit of claim 8, wherein the buffer circuit further includes:

a resistor that is coupled between the emitter of the fourth transistor and the gate of the first transistor.

11. The low-voltage current mirror circuit of claim 8, wherein the buffer circuit further includes:

a fifth transistor having at least a base, a collector, and an emitter, wherein the base of the fifth transistor is coupled to the emitter of the fourth transistor, and wherein the emitter of the fifth transistor is coupled to the gate of the first transistor.

12. The low-voltage current mirror circuit of claim 11, wherein the buffer circuit further includes:

a bias current source that is coupled to the emitter of the fourth transistor; and another bias current source that is coupled to the emitter of the fifth transistor, wherein the bias current source and the other bias current source are configured to provide currents such that a base-to-emitter voltage of the fourth transistor and a base-to-emitter voltage of the fifth transistor are substantially equal.

13. A low-voltage current mirror circuit, comprising:

a current mirror including a first transistor and a second transistor, wherein the first transistor has at least a gate, a drain, and a source; the second transistor has at least a gate, a drain, and a source; and wherein the gate of the first transistor is coupled to the gate of the second transistor;

a third transistor having at least a gate, a drain, and a source, wherein the source of the third transistor is coupled to the drain of the first transistor, and wherein the gate of the third transistor is coupled to the drain of the third transistor; and a buffer circuit that is coupled to the gate of the first transistor and the gate of the third transistor, wherein the buffer circuit is operable to cause a voltage at the gate of the third transistor to be substantially equal to the voltage at the gate of the first transistor, wherein the third transistor is arranged to receive a current at the drain of the third transistor such that the drain current of the third transistor is sufficiently small that a voltage difference between the gate and source of the third transistor is roughly equal to a threshold voltage of the third transistor, and wherein the threshold voltage of the third transistor is approximately equal to the threshold voltage of the first transistor.

14. The low-voltage current mirror circuit of claim 13, wherein the third transistor is a MOSFET or a MESFET.

15. The low-voltage current mirror circuit of claim 13, wherein the buffer circuit is an op amp that is arranged as a follower.

16. The low-voltage current mirror circuit of claim 13, wherein the buffer circuit is a folded buffer.

17. The low-voltage current mirror circuit of claim 16, wherein the folded buffer includes:

a fourth transistor having at least a base, a collector, and an emitter, wherein the base of the fourth transistor is coupled to the gate of the third transistor;

a fifth transistor having at least a base, a collector, and an emitter, wherein the base of the fifth transistor is coupled to the emitter of the fourth transistor, and wherein the emitter of the fifth transistor is coupled to the gate of the first transistor;

a bias current source that is coupled to the emitter of the fourth transistor; and another bias current source that is coupled to the emitter of the fifth transistor, wherein the bias current source and the other bias current source are configured to provide currents such that a base-to-emitter voltage of the fourth transistor and a base-to-emitter voltage of the fifth transistor are substantially equal.

18. The low-voltage current mirror circuit of claim 17, wherein the first transistor is a MOSFET or a MESFET, the second transistor is a MOSFET or a MESFET, the third transistor is a MOSFET or a MESFET, the fourth transistor is a bipolar transistor, and the fifth transistor is a bipolar transistor.

19. A method for low-voltage current mirroring, comprising:

providing an input current to a current mirror, wherein the current mirror includes a first transistor and a second transistor, a gate of the first transistor is coupled to a gate of the second transistor, and wherein the input current is provided to a drain of the first transistor; and employing a third transistor to cause a drain-to-source voltage of the first transistor to be roughly equal to a gate-to-source voltage of the first transistor minus a threshold voltage ($V_{TH}$) of the first transistor, wherein the source of the third transistor is coupled to the drain of the first transistor.

20. The method of claim 19, wherein employing the third transistor to cause the drain-to-source voltage of the third transistor to be roughly equal to the drain-to-source voltage of the first resistor minus $V_{TH}$ includes:

causing the voltage at the gate of the third transistor to be approximately equal to the voltage at the gate of the first transistor; and causing a drain current of the third transistor to be sufficiently small that a gate-to-source voltage of the third transistor is roughly equal to $V_{TH}$, wherein the third transistor is a MOSFET or a MESFET.

21. The method of claim 19, wherein employing the third transistor to cause the drain-to-source voltage of the third transistor to be roughly equal to the drain-to-source voltage of the first resistor minus $V_{TH}$ includes:

providing a buffered voltage at the gate of the third transistor by buffering the voltage at the gate of the first transistor.

22. The method of claim 19, wherein causing the voltage at the gate of the third transistor to be approximately equal to the voltage at the gate of the first transistor includes:

providing a buffered voltage at the gate of the third transistor by buffering the voltage at the gate of the first transistor.

* * * * *

UNITED STATES PATENT AND TRADEMARK OFFICE

CERTIFICATE OF CORRECTION

PATENT NO. : 7,432,696 B1
APPLICATION NO. : 11/185055
DATED : October 7, 2008
INVENTOR(S) : Frank J. De Stasi It is certified that error appears in the above-identified patent and that said Letters Patent is hereby corrected as shown below:

On the Title page, item (57), under "Abstract", in column 2, line 8, delete "gage" and insert -- gate --, therefor.

In column 1, line 39, delete "art." and insert -- art; --, therefor.

Signed and Sealed this

Thirtieth Day of December, 2008

JON W. DUDAS
*Director of the United States Patent and Trademark Office*